US005555657A

United States Patent [19]

Sorbini

[11] Patent Number: 5,555,657

[45] Date of Patent: Sep. 17, 1996

[54] SYSTEM FOR FASTENING INTERCHANGEABLE ADVERTISEMENTS TO A SUPPORTING STRIP

[75] Inventor: Franco Sorbini, Ivrea, Italy

[73] Assignee: Dima S.r.l., Ivrea, Italy

[21] Appl. No.: 186,301

[22] Filed: Jan. 25, 1994

[30] Foreign Application Priority Data

Jan. 26, 1993 [IT] Italy ..... TO93A0043

[51] Int. Cl.[6] ..... G09F 11/18

[52] U.S. Cl. ..... 40/518; 428/43

[58] Field of Search ..... 40/518, 514, 524, 40/471; 428/194, 40, 41, 202

[56] References Cited

U.S. PATENT DOCUMENTS

| | | | |
|---|---|---|---|
| 3,125,460 | 3/1964 | Rose | 40/594 |
| 4,643,729 | 2/1987 | Laplanche | 604/389 |
| 5,174,055 | 12/1992 | Aiker | 40/518 |
| 5,202,169 | 4/1993 | Spendlove | 428/43 |

FOREIGN PATENT DOCUMENTS

| | | | |
|---|---|---|---|
| 2514074 | 10/1976 | Germany | 40/471 |
| 8903570 | 4/1989 | WIPO | 40/518 |
| 9008374 | 7/1990 | WIPO | 40/518 |

*Primary Examiner*—Kenneth J. Dorner
*Assistant Examiner*—Cassandra Davis
*Attorney, Agent, or Firm*—Baker & Daniels

[57] ABSTRACT

An advertisement fastening system for a display device wherein a supporting strip is wound and unwound between two parallel rollers. Each edge of the advertisement is fitted with a number of fastening labels, each comprising two adhesive elements which are bonded respectively to the advertisement and the supporting strip, and are fixed permanently to a strip of elastic material. The adhesive elements are carried on two faces of two spaced portions of the elastic strip which also comprises a free portion for constantly tensioning the advertisement and enabling it to move in relation to the supporting strip when this is wound and unwound between the rollers.

12 Claims, 3 Drawing Sheets

SYSTEM FOR FASTENING INTERCHANGEABLE ADVERTISEMENTS TO A SUPPORTING STRIP

BACKGROUND OF THE INVENTION

The present invention relates to a system for fastening interchangeable advertisements to a supporting strip wound and unwound between at least two parallel rollers.

Various types of devices are known for displaying a series of advertisements in a display window, e.g. a transparent window with back lighting. On one known device, the advertisements are joined into a strip which is fed back and forth on rollers for selecting and displaying a given advertisement.

A major drawback of this type of device is that, to change one or more of the advertisements, the entire strip must be dismantled and the advertisements formed into a new strip, which operation involves considerable downtime during which the device, if used commercially for several advertisers with different display schedules, is substantially unusable.

On another known device, the strip is fed along an endless path defined by a series of parallel guide rollers about which the strip is wound and fed in one direction only, and a removable fastening system is provided for fastening the advertisements in interchangeable manner to the strip.

The fastening system comprises a strip of adhesive material placed on, and perpendicular to the traveling direction of, the supporting strip at the required location of the leading edge of the advertisement. Due to the difference in the winding diameter of the advertisement and the underlying supporting strip, however, the advertisement, as it travels over the rollers, slides in relation to the supporting strip, for which reason, the trailing edge of the advertisement is left unfastened to enable it to slide freely in relation to the supporting strip.

Such a system, however, is unsuitable for display devices wherein the supporting strip is wound and unwound between two rollers rotating in both directions. In this case in fact, while moving freely in relation to the supporting strip as this travels in one direction, the free edge of the advertisement cannot be fed forward when the supporting strip is inverted, which would require feeding the free edge forward in relation to the supporting strip and inserting it inside the turn of the supporting strip on the roller.

SUMMARY OF THE INVENTION

It is an object of the present invention to provide a system for fastening advertisements removably to a supporting strip, designed to overcome the aforementioned drawbacks typically associated with known systems, and which is extremely straightforward and reliable, even when applied to supporting strips traveling in both directions.

According to the present invention, there is provided a system for fastening interchangeable advertisements to a supporting strip wound and unwound between at least two parallel rollers; said rollers being rotatable for selecting the advertisement for display in a display window; and each advertisement comprising two edges substantially perpendicular to the traveling direction of said supporting strip; characterized by the fact that each advertisement is fastened to said supporting strip by removable fastening means located at each said edge; and each said fastening means enabling elastic displacement of the respective edge in relation to said supporting strip and in said direction.

More specifically, each fastening means comprises at least two adhesive elements affixed removably to the advertisement and the supporting strip; said adhesive elements being connected by a third element yieldable elastically in said direction.

According to a preferred embodiment of the present invention, the adhesive elements are fixed to and located on two opposite faces of an elastic strip.

BRIEF DESCRIPTION OF TEE DRAWINGS

Two preferred non-limiting embodiments of the present invention will be described by way of example with reference to the accompanying drawings, in which.

DETAILED DESCRIPTION OF THE INVENTION

Figure 1:
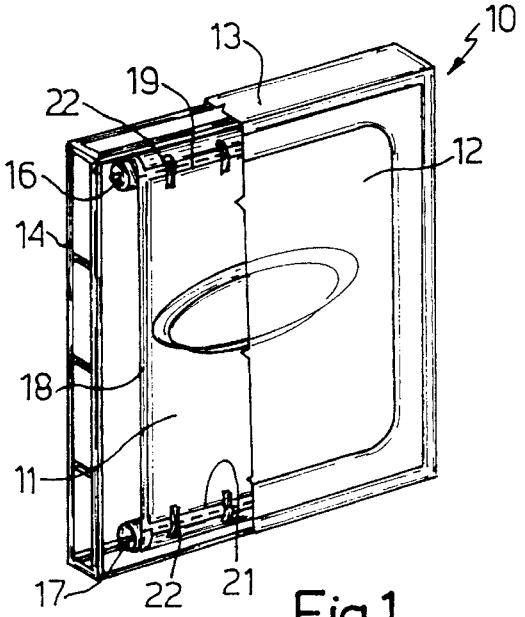
FIG. 1 shows a partially sectioned view in perspective of an advertising display device featuring a system for fastening the advertisements to a supporting strip according to a first embodiment of the present invention.

Number 10 in FIG. 1 indicates a commercial device for displaying advertisements 11 in a display window 12, e.g. lighted internally, according to the requirements of different advertisers.

More specifically, device 10 comprises a box 13 which may be opened for enabling access to the inside, and which presents a transparent front wall constituting window 12. Box 13 houses a frame 14, two sides of which, e.g. the two vertical sides, are fitted with two rollers 16 and 17, the respective axes of which are horizontal and hence parallel to each other.

Advertisements 11 are substantially transparent and fitted removably to a supporting strip 18 made of transparent, nonstretch laminated plastic material, e.g. 0.1–0.2 mm thick Mylar (registered trade mark). For advertisements 11 of less than 2 m in width, 0.17 mm thick laminated material may be used.

Supporting strip 18 is fitted at both ends to rollers 16 and 17 in any known manner, and is wound and unwound between rollers 16 and 17 which are rotatable both ways for selecting a given advertisement 11 for display in window 12, while at the same time maintaining a substantially constant tension of supporting strip 18.

Figure 7:
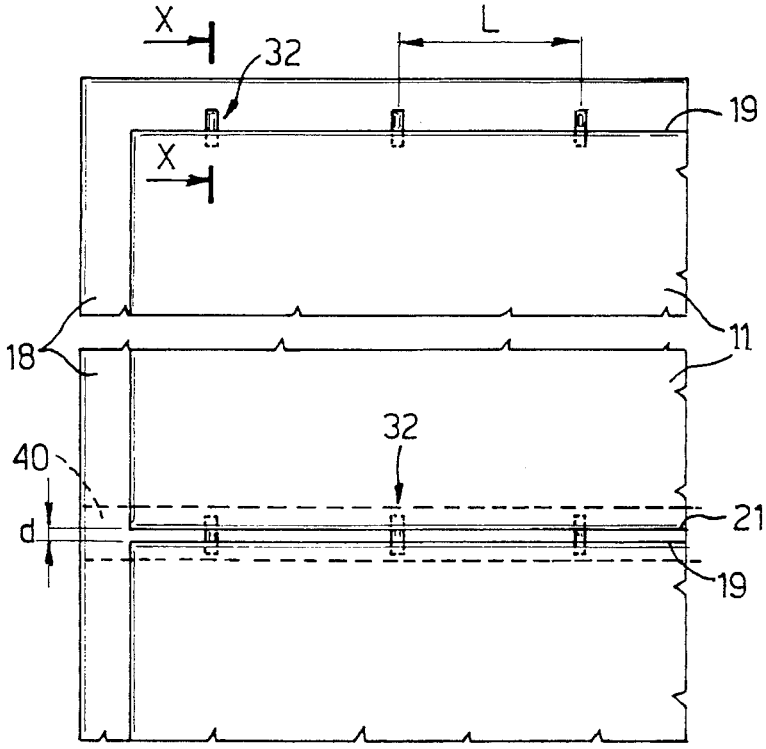
FIG. 7 shows a larger-scale front view of a portion of the supporting strip featuring a fastening system according to a further embodiment of the present invention.

For enabling troublefree commercial operation according to advertisers' requirements, advertisements 11 are fitted in interchangeable manner to supporting strip 18. According to the present invention, the system whereby advertisements 11 are fitted to supporting strip 18 comprises removable fastening means indicated as a whole by 22, 32 (FIGS. 2 and 7), arranged along edges 19 and 21 of each advertisement 11, perpendicular to the traveling direction of supporting strip 18, and which provide for enabling elastic displacement of the corresponding edge 19, 21 in relation to supporting strip 18 and in said direction.

Figure 4:
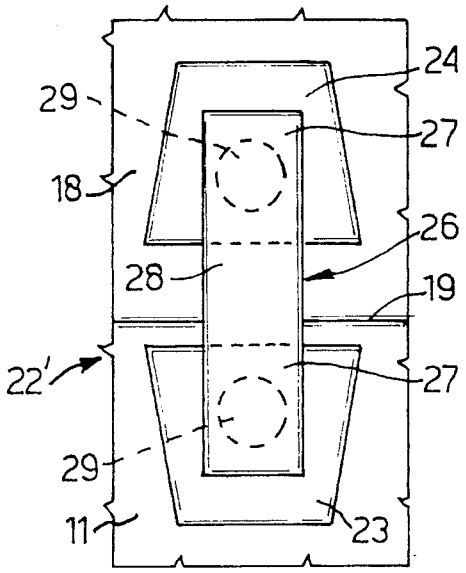
FIG. 4 shows a larger-scale view of a detail in FIG. 2.
Figure 9:
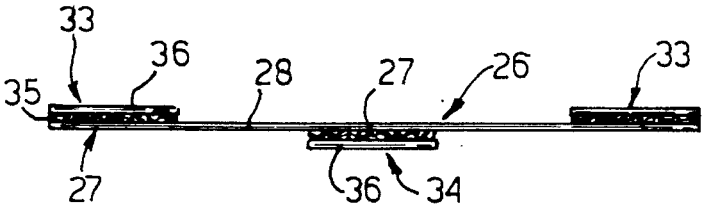
FIG. 9 shows a section along line IX—IX in FIG. 8.
Figure 10:
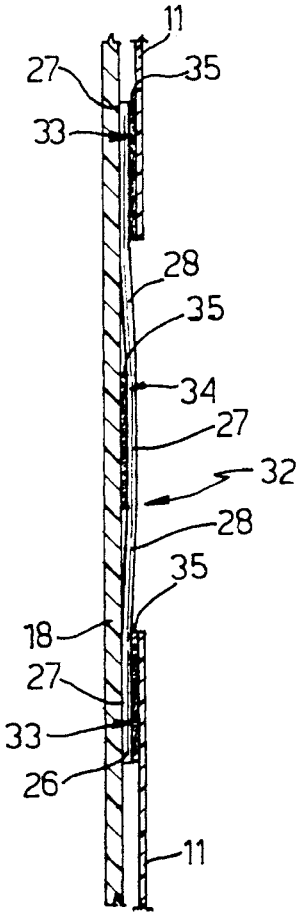
FIG. 10 shows a greatly enlarged section along line X—X in FIG. 7.

Fastening means 22, 32 (FIGS. 4 and 9) comprise a yieldable element 26 having two spaced portions 27 with an adhesive layer 25, 35 of strongly adhesive, high-temperature-resistant material. Yieldable element 26 is in the form of a rectangular strip of elastomeric material having a stretch coefficient of at least 100% and preferably ranging between 600 and 800%.

Portions 27 are separated by a freely stretchable portion 28; and strip 26 is made from transparent latex, and presents a section with a width of at least 5 mm and preferably of 2 to 3 cm, and a thickness of 0.1 to 0.3 mm. Portion 28 is of such a length as to ensure at least 4 mm stretch.

According to a first embodiment of the present invention, each fastening means 22 (FIG. 2) is represented by an assembly and may be of two different types. One type 22' provides for fastening edge 19 or 21 of an isolated or end advertisement 11 to supporting strip 18; while the other type 22" provides for simultaneously fastening two edges 19 and 21 of two successive advertisements 11 to supporting strip 18. More specifically, each fastening assembly 22' and 22" comprises at least two adhesive elements 23 and 24 fitted to strip 26 and affixable respectively to advertisement 11 and supporting strip 18.

Figure 6:
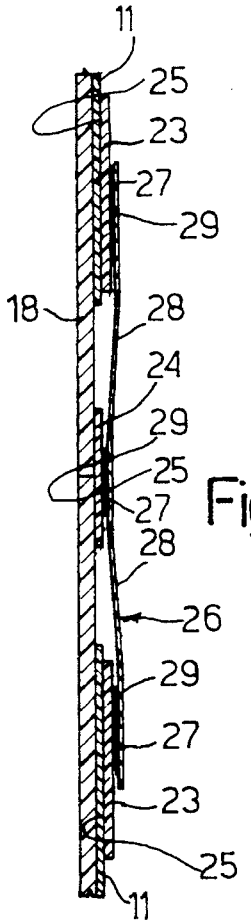
FIG. 6 shows a section along line VI—VI in FIG. 5.

Elements 23 and 24 are in the form of a laminated portion of transparent plastic material, and may preferably be made of the same laminated material, possibly dulled, as supporting strip 18. One surface of each portion 23 and 24 presents adhesive layer 25 (FIG. 6), the free surface of which may present a cover film adhering only slightly to layer 25 and which may be removed easily prior to use of assembly 22.

In particular, layer 25 may consist of "Brand 853" two-sided adhesive tape produced by 3M. Laminated portions 23 and 24 are bonded or welded permanently to portions 27 (FIGS. 4–6) of strip 26 using, for example, a spot 29 of cyanoacrylate adhesive, or preferably using "Super Attak" adhesive marketed by Loctite Italia S.p.A.

Figure 5:
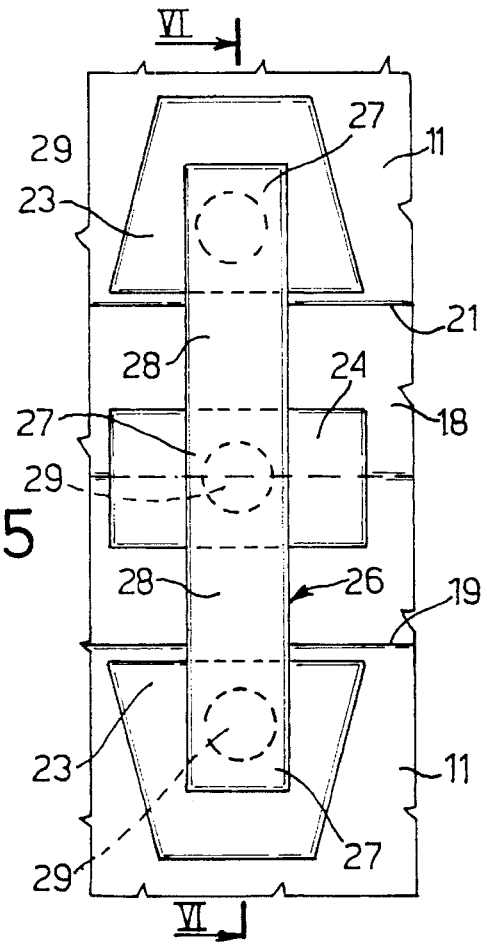
FIG. 5 shows a larger-scale view of a further detail in FIG. 2.
Figure 2:
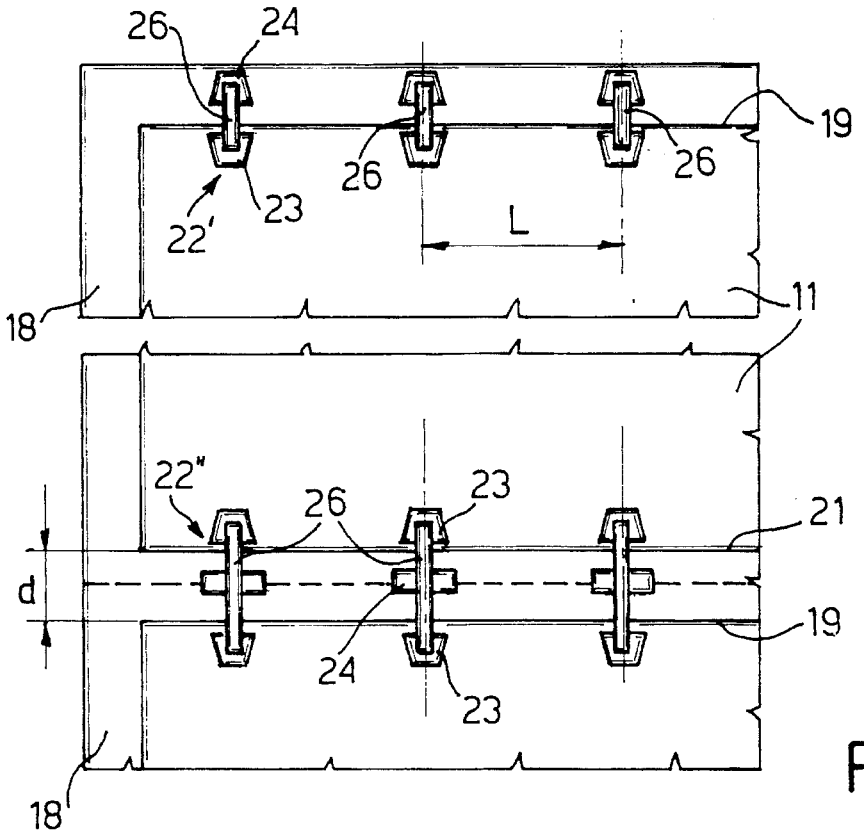
FIG. 2 shows a larger-scale front view of a portion of the FIG. 1 supporting strip.
Figure 3:
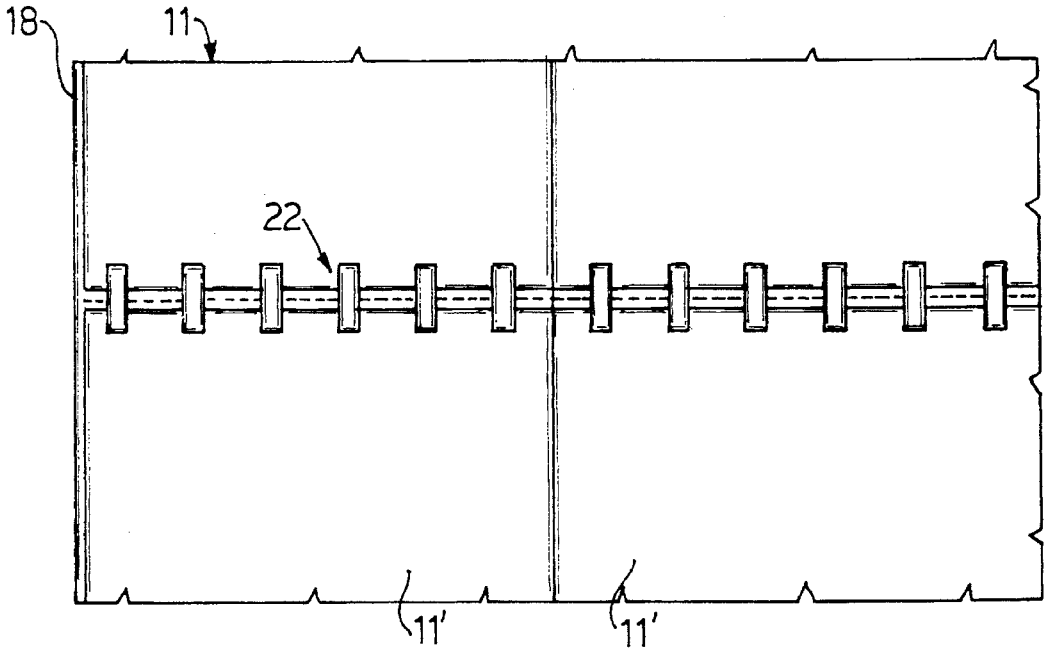
FIG. 3 shows a different scale front view of a variation of FIG. 2.

Advertisements 11 (FIG. 2) are normally fitted to supporting strip 18 sequentially in the traveling direction of strip 18, in which case they may be separated by a given distance "d" which may be reduced to a few centimeters. In FIGS. 2, 3 and 5, the dotted line indicates the separating line between to successive advertisements. Assembly 22' (FIG. 4) for fastening edge 19 or 21 of an end advertisement 11 to supporting strip 18 comprises two identical, e.g. trapezoidal-shaped, laminated portions 23 and 24.

Assembly 22" (FIG. 5) for fastening the adjacent edges 19 and 21 of intermediate advertisements 11 comprises two preferably trapezoidal-shaped laminated portions 23 which are bonded to edges 19 and 21 of two consecutive advertisements 11; and a rectangular portion 24 which is bonded to supporting strip 18; in which case, elastic strip 26 presents three portions 27 bonded to laminated portions 23 and 24, and two freely stretchable portions 28.

Assemblies 22' and 22" (FIG. 2) are substantially equally spaced along each edge 19 and 21 of advertisement 11 at a distance "L" of preferably 10 to 30 cm, and are arranged along the two edges 19 and 21 of each advertisement 11 so as to be aligned parallel to the traveling direction of supporting strip 18.

In the FIG. 3 variation, advertisement 11 is of considerable width and, for practical reasons, is divided into longitudinal strips 11', each of which is therefore fastened removably using assemblies 22' and 22" as in FIG. 2, but taking care to ensure the lateral edges of strips 11' are joined accurately.

In the embodiment shown in FIGS. 7 to 10, fastening means 32 are all in the form of one type of label for connecting edge 19 or 21 of advertisement 11 to supporting strip 18, and which presents two identical adhesive end elements 33 (FIG. 9) and a third central adhesive element 34. Elements 33 and 34 consist of a layer of two-sided adhesive tape 35, are bonded to opposite faces of portions 27 of strip 26, are separated by stretchable portion 28, and each present a protective cover film 36 of a material adhering only slightly to adhesive layer 35.

More specifically, each label 32 may be formed from a continuous strip 37 (FIG. 8) made of the same elastic material as strip 26. On the opposite faces of strip 37, a central band 38 and two bands 39 adjacent to the edges of strip 37 present adhesive layer 35 and cover film 36. For layer 35 with cover film 36, 12 mm wide "Scotch 969" transfer adhesive tape produced by 3M may preferably be used.

Figure 8:
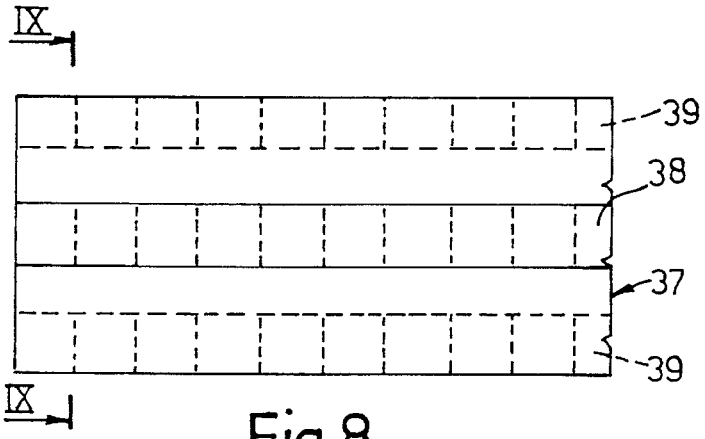
FIG. 8 shows a larger-scale view of a fastening strip for the FIG. 7 system.

Each label 32 may be cut when needed off strip 37, by cutting off a portion of the required size and possibly premarked on film 36 as shown by the dotted lines in FIG. 8. Once label 32 is cut off, film 36 is removed easily from elements 33 and 34; central element 34 is bonded to supporting strip 18; and the two end elements 33 are bonded to edges 19 and 21 of two adjacent advertisements 11. In the case of labels 32 bonded to end advertisement 11, film 36 need not be removed from the unused element 33.

Labels 32 provide for minimizing or eliminating gap "d" between one advertisement 11 and the next on supporting strip 18. Each advertisement 11 in fact is fastened by labels 32 directly on supporting strip 18 and substantially equally spaced by distance "L". By virtue of elements 33, 34 being located on the opposite faces of strip 26, most of label 32 is located beneath adjacent advertisements 11 and therefore substantially invisible.

Both strip 26 and adhesive layer 35 are made of transparent material and therefore in no way affect viewing of the advertisement. Nevertheless, to render labels 32 totally invisible, provision may be made on supporting strip 18 for a dulled strip 40 (FIG. 7) which also serves to indicate the location of the adjacent edges of successive advertisements 11.

Advertisements 11 are fastened using means 22 and 32 as follows.

As advertisements 11 are normally fixed to the outer surface of supporting strip 18, they are wound on to rollers 16 and 17 (FIG. 1) outwards of the turns in supporting strip 18. Assemblies 22' and 22" or labels 32 (FIGS. 2 and 7) are bonded to advertisements 11 and supporting strip 18 so that, when strip 18 is set flat, e.g. in display window 12, freely stretchable portion 28 (see also FIGS. 4, 5 and 10) is stretched slightly so as to slightly tension advertisement 11 on supporting strip 18.

When supporting strip 18 is wound from the flat display position on to top roller 16 together with advertisement 11, the top edge 19 engages roller 16, or the existing turns in strip 18, with substantially no slippage in relation to strip 18. As it is wound, however, advertisement 11, being on the outside of strip 18, presents a greater winding diameter and therefore slips gradually forward, i.e. upwards, in relation to strip 18. As a result, freely stretchable portion 28 of strip 26 fitted to edge 21 of advertisement 11 is gradually stretched to permit gradual displacement of edge 21.

Similarly, when advertisement 11 is wound on to bottom roller 17, the bottom edge 21 undergoes no slippage in relation to strip 18; and this time it is the freely stretchable portion 28 of strip 26 fixed to edge 19 which is stretched to permit displacement of edge 19 in relation to strip 18.

Consequently, when advertisements 11 are wound on to top roller 16, portions 28 of edge 21 are tensioned and those of edge 19 substantially relieved; whereas, when advertisements 11 are wound on to bottom roller 17, portions 28 of edge 19 are tensioned and those of edge 21 relieved.

When advertisement 11 is unwound off top roller 16 into the flat display position, portions 28 of strips 26 along edge 21 provide for pulling edge 21 along supporting strip 18 and so eliminating any folds or creases in advertisement 11. Similarly, when advertisement 11 is unwound off bottom roller 17, portions 28 of strips 26 along edge 19 provide for tensioning and keeping advertisement 11 perfectly taut.

The advantages of the fastening system according to the present invention will be clear from the foregoing description. In particular, it provides for troublefree replacement of advertisements 11, and for maintaining them perfectly taut as they are wound and unwound between rollers 16 and 17. Moreover, labels 32 may be produced easily from a web 37 of elastic material having bands 38 and 39 on the opposite faces, covered with commercial two-sided adhesive tape 35, 36.

To those skilled in the art it will be clear that changes may be made to the fastening system as described and illustrated herein without, however, departing from the scope of the present invention. For example, advertisements 11 may be of any size; rollers 16 and 17 may be arranged vertically as opposed to horizontally; and advertisements 11 may be placed behind supporting strip 18 so that, as they are wound on to each roller 16, 17, they slide backwards in relation to the traveling direction of strip 18. In which case, assemblies 22' and 22" or labels 32 are bonded to edges 19 and 21 of advertisements 11 so as to be tensioned when advertisement 11 is in the flat display position.

Moreover, strips 26, elements 23, 24 of assemblies 22' and 22", and labels 32 may differ in shape and size and be made of different materials as compared with those described herein; and, in the embodiment shown in FIGS. 7–10, each advertisement 11 may be fastened using labels 32 independent of those of the adjacent advertisements 11.

Label 32 may feature only two adhesive elements 33, 34 for attachment to advertisement 11 and supporting strip 18 respectively, which type of label may be used anyway for fastening isolated or end advertisements 11. Finally, strip 26 may be welded as opposed to bonded to elements 23 and 24; and elements 23 and 24 or 33 may be fitted mechanically or hooked on to advertisements 11 and supporting strip 18 as opposed to using adhesive.

I claim:

1. A system fastening interchangeable advertisements to a supporting strip, comprising:

at least two parallel rollers between which said supporting strip is wound and unwound, said rollers being rotatable for selecting the advertisement for display in a display window, each advertisement comprising two edges substantially perpendicular to a traveling direction of said supporting strip;

fastening labels located at each one of said two edges for removably fastening said advertisement to said supporting strip, each said fastening label comprising at least two adhesive elements consisting of a strongly adhesive high-temperature-resistant, two-sided adhesive layer removably bondable to said advertisement and to said supporting strip, said adhesive elements being provided on two opposite faces of a strip of transparent latex having a stretch coefficient between 600% and 800% to enable elastic displacement of the respective edges in relation to said supporting strip and in said direction, said adhesive elements including a protective cover film removable prior to fitment to said advertisement and said supporting strip.

2. A system fastening interchangeable advertisements to a supporting strip, comprising:

at least two parallel rollers between which said supporting strip is wound and unwound, said rollers being rotatable for selecting the advertisement for display in a display window, each advertisement comprising two edges substantially perpendicular to a traveling direction of said supporting strip;

fastening labels located at each one of said two edges for removably fastening said advertisement to said supporting strip, each said fastening label comprising at least two adhesive elements removably bondable to said advertisement and to said supporting strip, said adhesive elements being provided on two opposite faces of an elastic strip of elastomeric material to enable elastic displacement of the respective edge in relation to said supporting strip and in said direction.

3. A system as claimed in claim 2, wherein said elastic strip is made of transparent latex with a stretch coefficient between 600% and 800%.

4. A system as claimed in claim 3, wherein said elastic strip presents a section with a width of between 2 and 3 cm and a thickness of 0.1 to 0.3 mm, said fastening labels being equally spaced at a distance of 10 to 30 cm along each of said edges.

5. A system as claimed in claim 4, wherein said labels are arranged along said two edges so as to be substantially aligned parallel to said direction.

6. A system as claimed in claim 3, wherein said elastic strip presents two spaced portions, each having one of said adhesive elements, and a free portion between said spaced portions and of such a length as to ensure at least 4 mm stretch.

7. A system as claimed in claim 6, wherein said advertisements are so fitted to said supporting strip as to be wound on to said rollers outwards of said supporting strip, said adhesive elements being fitted so as to slightly preload said elastic portion and so maintain said advertisement slightly tensioned when flat.

8. A system as claimed in claim 3, wherein each said adhesive element consists of an adhesive layer for removable fitment to said advertisement and said supporting strip, said adhesive layer consisting of a strongly adhesive, high-temperature-resistant, two-sided adhesive layer.

9. A system as claimed in claim 8, wherein each said adhesive element includes a protective cover film removable prior to fitment to said advertisement and said supporting strip.

10. A system as claimed in claim 2, wherein said advertisements are fitted to said supporting strip sequentially in said traveling direction, each said fastening label being provided with a central adhesive element on one of said faces to be fitted to said supporting strip, and with two adhesive end elements on the other one of said faces to be fitted to two adjacent edges of two consecutive advertisements.

11. A system as claimed in claim 10, wherein each said label is formed by cutting off a portion of a web of the same material as said elastic strip, said strip presenting said adhesive layer with said protective cover film along two lateral bands on one surface, and along a central band on the opposite surface of said strip.

12. A system as claimed in claim 10, wherein said edges and said fastening labels are covered by a dulled strip to indicate where the adjacent edges of successive advertisements are located on said supporting strip.

* * * * *